United States Patent [19]

Birdsall

[11] 4,184,215

[45] Jan. 22, 1980

[54] TOILET FLUSHING APPARATUS

[76] Inventor: Leo S. Birdsall, 71 Carol Rd., Ormond Beach, Fla. 32074

[21] Appl. No.: 916,958

[22] Filed: Jun. 19, 1978

[51] Int. Cl.[2] ..... E03D 5/09; E03D 1/35

[52] U.S. Cl. ..... 4/411; 4/393

[58] Field of Search ..... 4/393, 392, 394, 395, 4/405, 384, 311, 324, 412, 414, 411, 386

[56] References Cited

U.S. PATENT DOCUMENTS

| | | | |
|---|---|---|---|
| 605,989 | 6/1898 | Bean | 4/412 |
| 1,103,141 | 7/1914 | Heap | 4/414 |
| 1,103,550 | 7/1914 | Stevens | 4/394 |
| 1,309,507 | 7/1919 | Bubb | 4/393 |
| 1,718,744 | 6/1929 | Koropczyk | 4/395 |
| 2,629,879 | 3/1953 | Bennett | 4/392 |
| 2,666,929 | 6/1954 | Schnepp | 4/392 |
| 2,733,449 | 2/1956 | Ware | 4/393 |
| 2,776,437 | 1/1957 | Detjen | 4/393 |
| 2,781,520 | 2/1957 | Micek | 4/393 |
| 2,849,724 | 9/1958 | Hofberger | 4/393 |
| 3,036,313 | 5/1962 | Jenkins | 4/324 |
| 3,908,203 | 9/1975 | Jackson | 4/394 |
| 3,969,775 | 7/1976 | Haselton | 4/393 |
| 4,000,526 | 1/1977 | Biela et al. | 4/394 |
| 4,080,669 | 3/1978 | Biggerstaff | 4/393 |

*Primary Examiner*—Henry K. Artis

*Attorney, Agent, or Firm*—John N. Randolph

[57] ABSTRACT

A toilet flush assembly having an imbalanced weight relationship between the flush handle and the arm of the tank lever, constructed and arranged to allow manual assistance in closing the outlet valve to thereby provide for limiting the amount of water passing from the toilet tank reservoir into the toilet bowl for flushing purposes.

5 Claims, 1 Drawing Figure

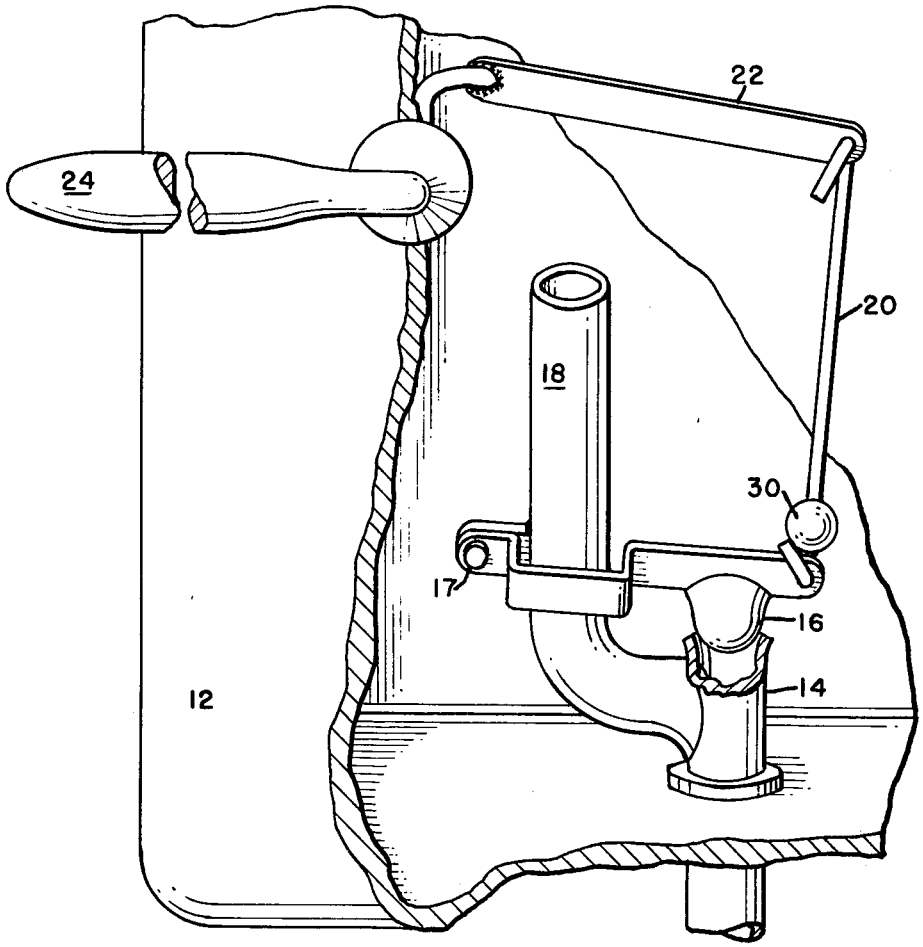
22
24
20
18
30
17
16
14
12

TOILET FLUSHING APPARATUS

The present invention relates to a water saving device and more particularly to a device useful in connection with limiting the amount of water allowed to pass out of a toilet tank reservoir each time a toilet is flushed.

The invention has as its principal object the provision of an imbalanced weight assembly used in connection with the flushing apparatus of a toilet tank assembly such that a wide range of control of the stopper blocking the discharge part between the toilet tank and toilet bowl may be accomplished by manipulation of the toilet tank handle rather than by wholly automatic means as heretofore used where such automatic means do not become fully operational until the tank is relatively completely discharged.

By use of the present invention, when it is visually determined that enough water has been allowed to pass out of the toilet tank for flushing purposes, a manual manipulation of the toilet tank handle can cause the discharge stopper means located within the tank to become operational thereby preventing further appreciable water from being discharged from the tank and thereby preventing waste of water, as for example when there are no solids to be flushed away.

The principal object as well as other objects and advantages of the invention will become readily apparent from the following description, taken in connection with the accompanying drawing wherein the FIGURE is a schematic view of the apparatus of the present invention.

A toilet tank 12 houses a conventional discharge opening 14 which cooperates with a flapper valve 16 in the usual manner as will be appreciated by those skilled in the art.

The discharge valve assembly cooperates with a standard overflow pipe 18. The flapper valve may be pivotally carried in the tank by any suitable means such as a pivot member 17 and, at its distal end, has connected thereto a lift member 20. The lift member 20, in turn, is coupled to a tank lever arm 22 which arm 22 is connected to a weighted handle 24 moveably carried on the toilet tank in the customary manner.

The lift member 20 carries, at its lower end, a weight member 30.

As will be appreciated, in the conventional toilet assembly, when the toilet is flushed the handle 24 is suitably turned thus raising the lever arm 22 and the connecting member 20 to raise the flapper valve. The flapper valve, in its conventional construction, has a buoyancy due to its construction of buoyant material and will remain suspended in the water above the discharge port until such time as the water level in the tank is lowered to approximately the level of the discharge valve whereupon the flapper valve will follow the water into the valve and seal the valve so that the toilet tank may be refilled.

In the present embodiment the reverse is true, that is, the weight 30 tends to cancel the buoyancy of the flapper member 16 so the flapper member will not float unless it is supported by outside means such as the handle 24 exerting an upward pull on the flapper 16.

It will be appreciated that even though in certain cases it is necessary and desireable to cause the full amount of water in the reservoir in the tank to be discharged through the valve to adequately flush the toilet, there are times when substantially less than the total amount of water in the reservoir need be discharged through the opening 14 in the toilet bowl in order to flush the toilet. Such cases are not provided for with a conventional toilet, however, since the flapper valve will not seal the port until nearly the full reservoir of water has been discharged because the valve is buoyant in the water and does not reseal the port until the water in the tank is nearly fully discharged.

By means of the apparatus of the instant invention, less than the full amount of water in the reservoir can be discharged into the toilet bowl for flushing purposes by merely turning the handle 24 in a direction opposite to the direction the handle is moved when the tank is flushed. By so turning the handle 24, this will cancel the lift of the lever 22 thereby causing the flapper valve 16 to move clockwise about its pivot to seal the discharge port 14 at any time. The movement of the flapper valve in this clockwise direction is assisted by the weight 30 carried on the rod member 20.

Thus, it will be seen that by means of the instant invention the toilet may be flushed at any time by turning the handle 24 in the conventional way; and with no further force applied to the handle, the toilet will flush in the conventional way by allowing the flapper valve, which is supported by its buoyancy and the lift of the tank lever arm 22, to ride slowly downwards in a clockwise direction as the water is discharged from the tank into the toilet bowl to ultimately seal the discharge port, when the tank empties to the level of the opening in said port and the flapper is no longer buoyantly supported by water. Should it be desirable, however, to cause less than the full amount of water in the reservoir to be discharged after moving the handle in the conventional way to flush the tank, the manipulator of the handle may then, when the toilet bowl is fully flushed, move the handle in the opposite direction, and thereby cause the flapper valve to sooner close the discharge port.

As an example: If we assume that the flapper valve weighs one ounce and that when immersed it will support a load of about one-half ounce in addition to its own weight, if the lever is made to furnish one ounce of lift and the weight 30 is one ounce, the two will counterbalance.

If now the tank lever handle is depressed thus raising the flapper valve, the valve will stay afloat because of the one-half ounce lift of the tank lever arm 22, the flapper valve is left with its one-half ounce bubble for support but loaded with a one-ounce load 30, thus it falls to the closed position when the tank is substantially empty whether the member 20 is a flexible chain or a rod; however, if the handle is swung upwardly the lever 22 will then no longer exert a lifting force on the member 20 so that the valve will close regardless of the water level in the tank 12.

Although in the instant disclosure I have shown a preferred embodiment of my invention, a range of alteration, modification, change and substitution is intended therein, and in some instances some features of the invention will be utilized without a corresponding use of other features. For example, the lift member 20 could be appropriately replaced by a flexible chain member. Accordingly, it is intended that the claims be construed in a manner consistent with the full range of the spirit and scope of the invention herein.

Having thus described my invention, I claim:

1. A toilet tank flushing apparatus comprising a toilet tank having an outlet port through the bottom thereof, a buoyant valve closing said port, a weight bearing on and retaining the valve in a closed position when submerged, a weighted flush handle swingably mounted on the tank, a lever fixed to said handle, said handle being gravity urged downwardly for exerting a lifting force on the lever, and a lift member having an upper end connected to the lever remote from the handle and a lower end connected to the valve whereby the valve and weight will be lifted when the flush handle is swung downwardly to cause the valve to assume an open position, the lifting force exerted by the handle on said lift member through the lever being sufficient to overcome the tendency of said weight to return the valve to a closed position until the water level in the tank falls sufficiently so that the valve is no longer buoyantly supported or until the flush handle is swung upwardly so that the lift member no longer exerts a lifting force on the valve.

2. A toilet tank flushing apparatus as in claim 1, said lift member comprising a rod.

3. A toilet tank flushing apparatus as in claim 1, said lift member comprising a non-elastic flexible member.

4. A toilet tank flushing apparatus as in claim 1, and means pivotally mounting said valve for up and down swinging movement above said outlet port.

5. A toilet tank flushing apparatus as in claim 1, said handle being disposed externally of the tank, said lever being disposed within the tank, said handle and lever extending in opposite directions from the portion of the tank in which said handle is turnably mounted.

* * * * *